United States Patent [19]

Nanami

[11] Patent Number: 4,820,255

[45] Date of Patent: Apr. 11, 1989

[54] SHEET FOLDING DEVICE

[75] Inventor: Hiroo Nanami, Shizuoka, Japan

[73] Assignee: Kabushikigaisha Nanami, Shizuoka, Japan

[21] Appl. No.: 160,374

[22] Filed: Feb. 25, 1988

[51] Int. Cl.[4] ..... B65H 45/20; B65H 45/18

[52] U.S. Cl. ..... 493/451; 493/456; 493/457; 493/956

[58] Field of Search ..... 493/405, 406, 417, 451, 493/456, 457, 956

[56] References Cited

U.S. PATENT DOCUMENTS

| | | | |
|---|---|---|---|
| 943,796 | 12/1909 | Shogran | 493/956 |
| 2,484,390 | 10/1949 | Thorpe et al. | 493/457 |
| 3,797,821 | 3/1974 | Crenshaw | 493/457 |
| 4,659,323 | 4/1987 | Ito et al. | 493/457 |

FOREIGN PATENT DOCUMENTS

| | | | |
|---|---|---|---|
| 1396048 | 3/1965 | France | 493/451 |

*Primary Examiner*—Frederick R. Schmidt
*Assistant Examiner*—William E. Terrell
*Attorney, Agent, or Firm*—Sughrue, Mion, Zinn, Macpeak and Seas

[57] ABSTRACT

A sheet folding device which can fold a sheet in an accordion fashion simply and efficiently and can improve the efficiency in production of artificial flowers. The device includes a set of fixed parallel folding plates provided in an equidistantly spaced relationship on a fixed base, and a set of movable folding plates mounted for individual parallel movement on a movable member pivotally mounted on the base. A stack of sheets of paper is placed on the fixed member between the movable folding plates and the fixed folding plates, and a manually operable member is operated whereupon the movable folding plates are successively moved into gaps between the fixed folding plates thereby to fold the paper sheet stack in an accordion fashion.

9 Claims, 7 Drawing Sheets

SHEET FOLDING DEVICE

BACKGROUND OF THE INVENTION

1. Field of the Invention

This invention relates to a sheet folding device for folding a sheet of paper or the like in an accordion fashion as a step of a process of making an artificial flower.

2. Description of the Prior Art

When it is intended to make an artificial flower in a kindergarten or a school using thin sheets of paper, conventionally a plurality of thin sheets of paper are at first layered one on another and then folded in an accordion fashion with a width of 1.5 cm or so, whereafter the thus folded piece of paper is bundled at an intermediate portion thereof and then opposite end portions of the individual sheets of paper are opened and arranged so as to form petal of a flower. By such a process, a three-dimensional artificial flower such as a rose can be formed.

However, the conventional process is very inefficient because much time and labor are required to fold layered sheets of paper in an accordion fashion. Accordingly, it is inconvenient to make a large number of artificial flowers by the process.

SUMMARY OF THE INVENTION

Accordingly, it is an object of the present invention to provide a sheet folding device which can fold a sheet in an accordion fashion simply and efficiently and can improve the efficiency in production of artificial flowers.

In order to attain the object, according to the present invention, there is provided a device for folding a sheet in an accordion fashion which comprises a fixed base having a sheet receiving table at the top thereof, a movable member mounted for movement between an inoperative position in which a sheet can be placed on the sheet receiving table of the base and an operative position in which the movable member is positioned above the fixed base with a predetermined gap left therebetween a set of fixed folding plates provided on the fixed base and arranged in parallel to each other with predetermined spacings left therebetween, a set of movable folding plates mounted on the movable member for individual parallel movement in the same planes with the spacings between the fixed foldings plates, each of the movable folding plates being movable between an inoperative position in the movable member and an operative position wherein it is fitted in a corresponding one of the spacings between the ribs when the movable member is in the operative position, and a manually operable actuating means for successively moving the movable folding plates from the inoperative positions to the operative positions to fold, cooperating with the fixed folding plates when the movable member is in the operative position, a sheet received on the sheet receiving table of the base in an accordion fashion.

With the sheet folding device of the invention, if a stack of sheet of paper is placed on the sheet receiving table of the fixed base and the actuating means is manually operated, then the paper sheet stack is folded in an accordion fashion. Thus, by suitably treating the paper sheet stack, an artificial flow can be formed readily.

Accordingly, the working efficiency in making artificial flowers can be improved significantly by the sheet folding device of the invention. Also where the sheet folding device of the present invention is applied to folding of plastic films or the like, the folding workability can be improved significantly.

The above and other objects, features and advantages of the present invention will become apparent from the following description and the appended claims, taken in conjunction with the accompanying drawings.

Figure 1:
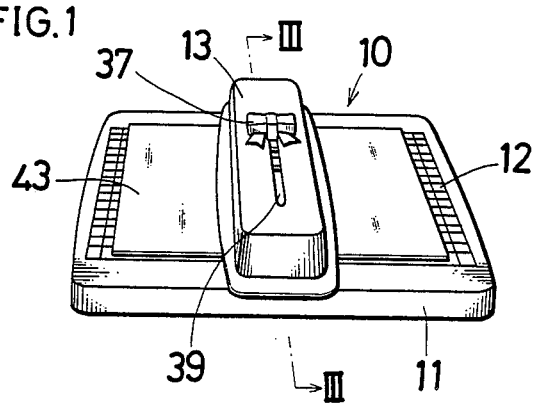
FIG. 1 is a perspective view of a sheet folding device showing a first embodiment of the present invention.
Figure 8:
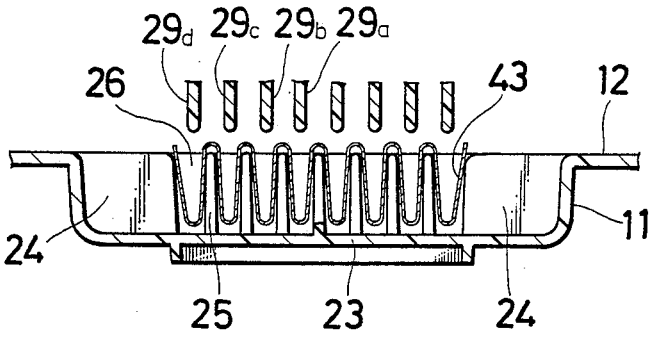
Figure 9:
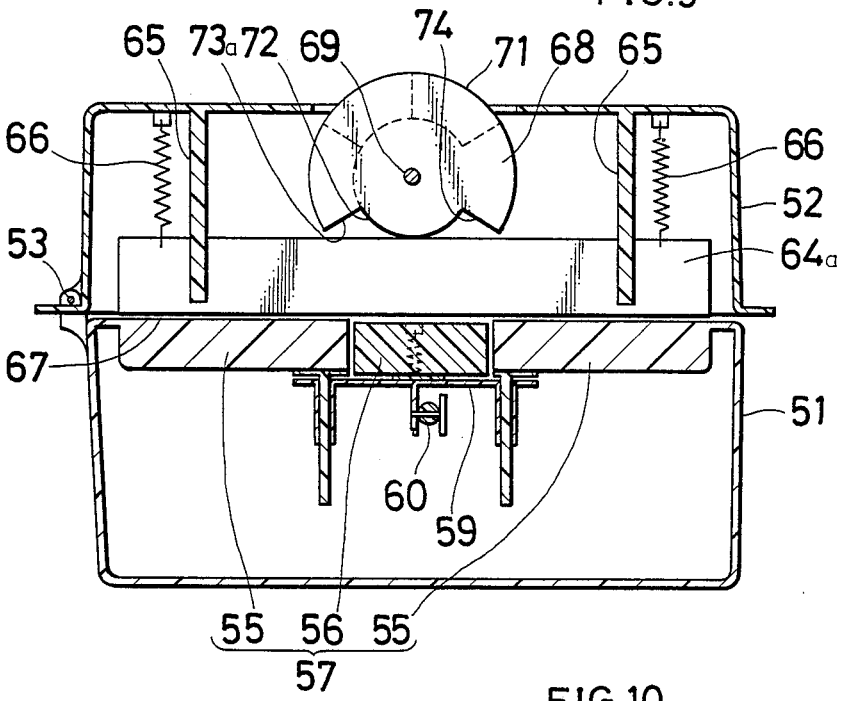
Figure 10:
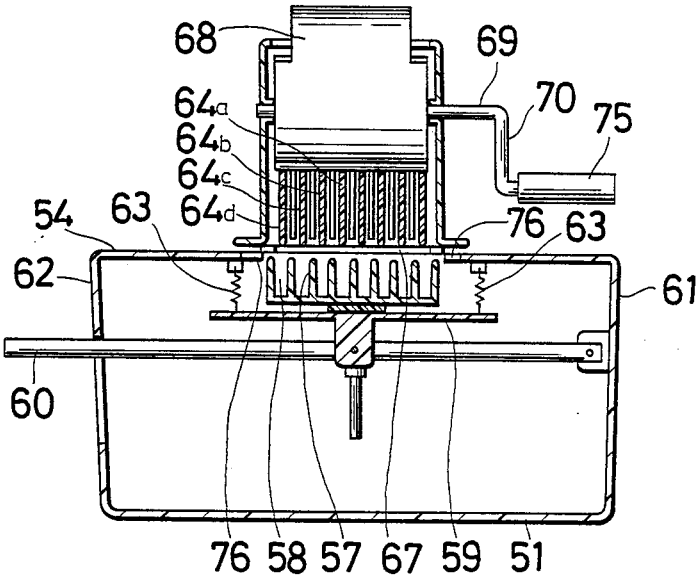
Figure 11:
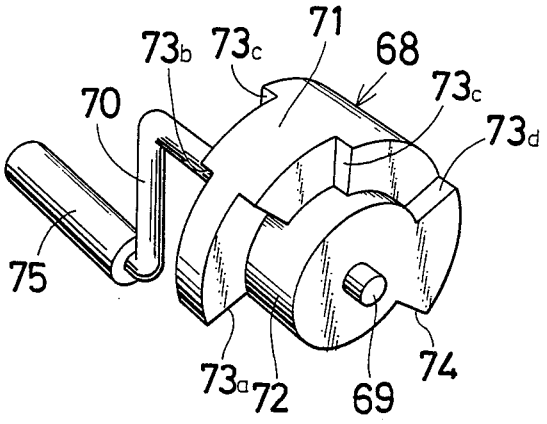

FIG. *7a* to *7e* are partial vertical sectional views showing different positions of the movable folding plates relative to cooperating fixed folding plates;

FIG. 8 is an enlarged partial vertical sectional view of the sheet folding device of FIG. 1 illustrating a sheet folded by the movable folding plates and the fixed folding plates;

FIG. 9 is a vertical sectional view of a sheet folding device showing a second embodiment of the present invention;

FIG. 10 is a sectional view taken along line X—X of FIG. 9;

FIG. 11 is an enlarged perspective view of a cam member for actuating movable folding plates of the sheet folding device of FIG. 9; and FIGS. 12*a* to 12*d* are perspective view of different stages of a process of making an artificial flower.

DETAILED DESCRIPTION OF THE PREFERRED EMBODIMENTS

Figure 2:
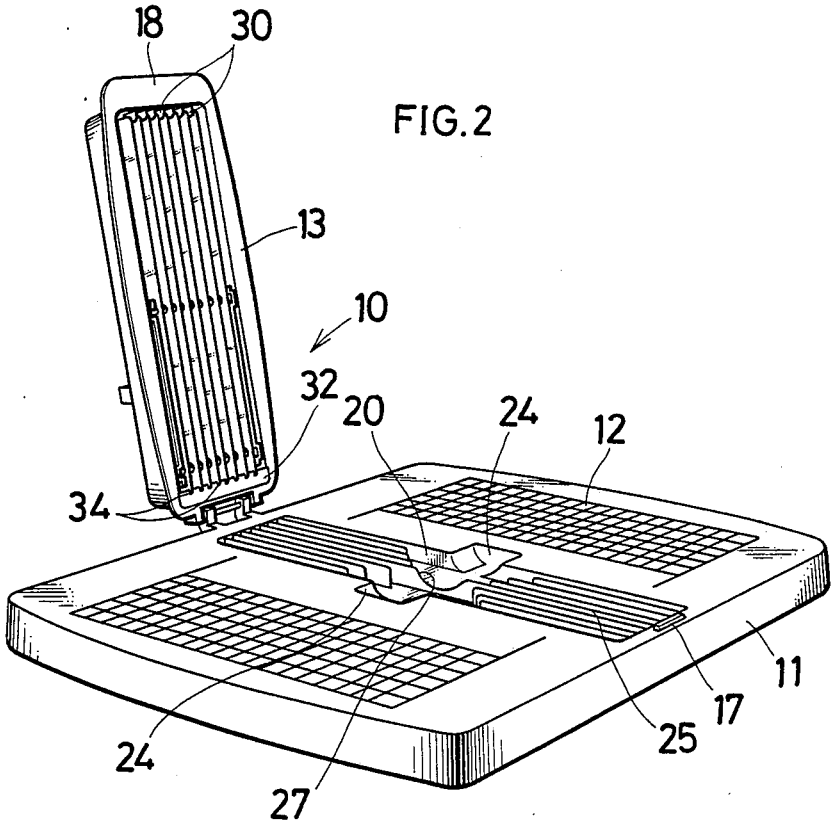
FIG. 2 is an enlarged perspective view of the sheet folding device of FIG. 1 with a movable member positioned at an upwardly pivoted position.

Referring first to FIGS. 1 and 2, there is shown a sheet folding device embodying the present invention. The sheet folding device generally denoted at 10 includes a lower base 11 having a sheet receiving table 12 at the top thereof, and an upper movable member 13 supported at a rear end portion thereof for pivotal motion between a lower operative position as shown in FIG. 1 and an upper inoperative position as shown in FIG. 2 relative to the base 11.

Figure 3:
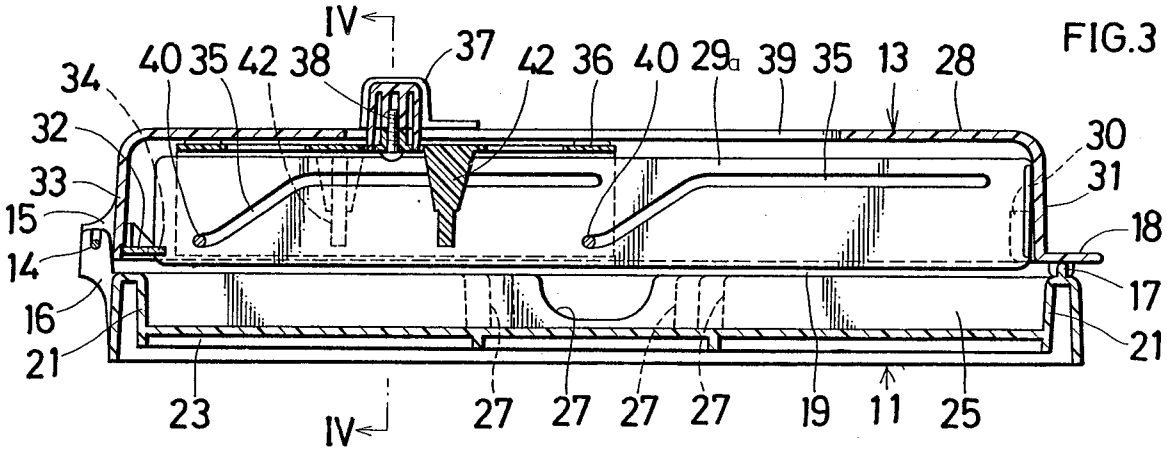
FIG. 3 is a vertical sectional view taken along line III—III of FIG. 1.

In particular, referring also to FIG. 3, the movable member 13 is mounted for pivotal motion on the base 11 by means of a shaft 14 which extends through a pair of projections 15 and another pair of projections 16 formed at rear ends of the movable member 13 and the base 11, respectively. A further projection 17 is formed at a forward end of an upper face of the base 11 and located for contacting with a forward extension 18 of the movable member 13 to define the lower operative position of the movable member 13 as shown in FIG. 3. In the lower operative position of the movable member 13, a gap 19 is left between the movable member 13 and the base 11 as seen in FIG. 3 such that a plurality of layered sheets of paper of a predetermined thickness placed on the sheet receiving face 12 of the base 11 may extend through and move in the gap 19.

Figure 4:
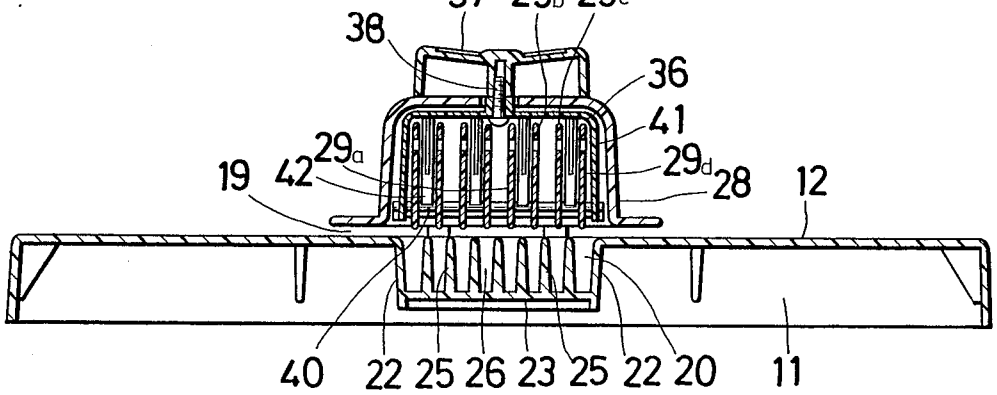
FIG. 4 is a sectional view taken along line IV-IV of FIG. 3.

Referring to FIGS. 2 to 4, the base 11 is formed as a unitary member from a plastic material by molding and has a recess 20 formed at a widthwise central location thereof an defined by a pair of front and rear walls 21, a pair of side walls 22 and a bottom wall 23. A pair of opposite sidewardly expanded portions 24 of a sufficient size to receive the thumb and a finger of a hand of an operator therein are formed at a substantially central location of the recess 20 of the base 11. A plurality of, seven in the embodiment, fixed folding plates 25 are formed in an equidistantly spaced relationship on an upper face of the bottom wall 23 with a plurality of gaps or spacings 26 left therebetween and between the outermost fixed folding plates 25 and the opposing side walls 22 of the recess 20 of the base 11. The fixed folding plates 25 extend in parallel to each other in a depthwise direction between the front and rear walls 21 and have central cutaway portions 27 formed therein such that the fixed folding plates 21 except the central one are each divided into two separate front and rear sections. The cutaway portions 27 of the six fixed folding plates 25 are greater in depthwise dimension toward the opposite sides such that the cutaway portions 27 of the two outermost fixed folding plates 25 have a greatest depthwise dimension while those of the two fixed folding plates 25 adjacent the central fixed folding plate 25 have a smallest depthwise dimension as particularly seen in FIG. 3.

Meanwhile, the movable member 13 includes a casing 28 made of a plastic material and having the projections 15 formed thereon. The casing 28 is formed as a box which is open at the bottom thereof. A plurality of, eight in the embodiment, movable folding plates 29*a*, 29*b*, 29*c* and 29*d* made of a plastic material are mounted for up and down movement in the casing 28. In particular, a plurality of ribs or projections 30 are formed on an inner face of a front wall 31 of the casing 28 while a guide plate 32 is securely mounted at a lower end of a rear wall 33 of the casing 28. The guide plate 32 has a plurality of slits 34 formed along a forward edge thereof. The movable folding plates 29*a*, 29*b*, 29*c* and 29*d* are fitted at front and rear ends thereof between the projections 30 and in the slits 34 of the guide plate 32 so that they are guided for up and down movement in the operative position of the movable member 13.

The the movable folding plates 29*a*, 29*b*, 29*c* and 29*d* are located in an opposing relationship to the spacings 26 in the recess 20 of the base 11, that is, in the same planes with the spacings 26 so that they can be moved down into the spacings 26.

Figure 6:
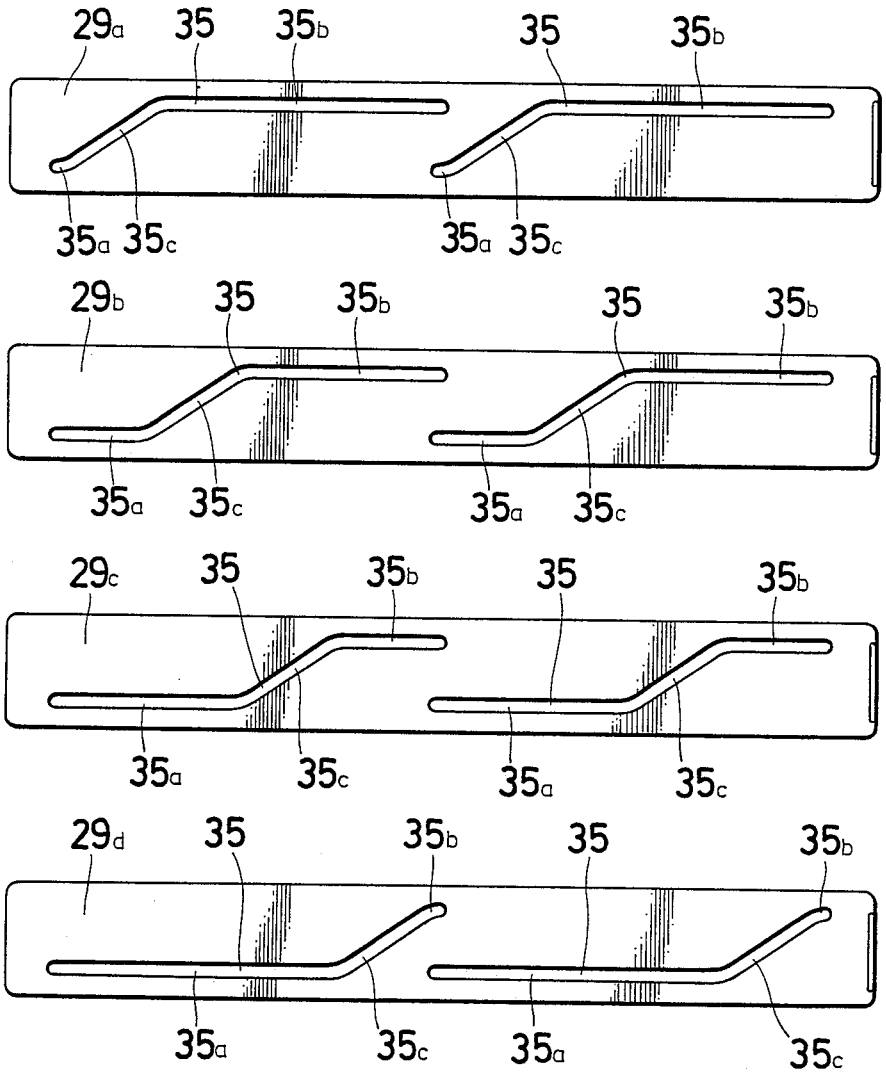
FIG. 6 is an exploded view of movable folding plates of the movable member of FIG. 2.

Referring to FIG. 6, each of the movable folding plates 29*a*, 29*b*, 29*c* and 29*d* has a pair of guideways or cam slots 35 of a similar shape formed therein. Each of the guideways 35 of the movable folding plates 29*a*, 29*b*, 29*c* and 29*d* includes a lower horizontal portion 35*a*, an upper horizontal portion 35*b* and an intermediate inclined portion 35*c* interconnecting the lower and upper horizontal portions 35*a* and 35*b*. The guideways 35 have an equal length in the longitudinal direction of the movable folding plates 29*a*, 29*b*, 29*c* and 29*d*, and the inclined portions 35*c* of the guideways 35 of the movable folding plates 29*a*, 29*b*, 29*c* and 29*d* are formed in a mutually offset relationship such that the upper end of the inclined portion 35*c* of the guideway 35 of a movable folding plate 29*a*, 29*b* or 29*c* is located at a same position in the longitudinal direction as the lower end of the inclined portion 35*c* of the guideway 35 of an adjacent next movable folding plate 29*b*, 29*c* or 29*d*. Accordingly, for example, the upper end of the inclined portion 35*c* of the guideway 35 of the movable folding plate 29*a* is located at the same position in the longitudinal direction as the lower end of the inclined portion 35*c* of the guideway 35 of the movable folding plate 29*b* as seen in FIG. 6. The movable folding plates 29*a*, 29*b*, 29*c* and 29*d* are disposed in the casing 28 such that the movable folding plates 29*a* are located at the center and the other movable folding p;plates 29*b*, 29*c* and 29*d* are located on the opposite sides of the movable folding plates 29*a* in this order as particularly seen in FIG. 4.

A mechanism for actuating the movable folding plates 29*a*, 29*b*, 29*c* and 29*d* to move in up and down directions is also provided on the movable member 13. In particular, referring to FIGS. 3 and 4, the actuating mechanism includes a slider 36 made of a plastic material and having a substantially channel-shaped vertical section as shown in FIG. 4. The slider 36 is fitted for forward and rearward movement in the casing 28. A knob 37 made of a plastic material is secured to the top of the slider 36 by means of a fastening screw 38 and extends outwardly upwardly through an elongated hole 39 formed in the casing 28. Thus, the slider 36 is supported for sliding movement in the depthwise direction on the casing 28 of the movable member 13 under the guidance of the elongated hole 39.

Figure 5:
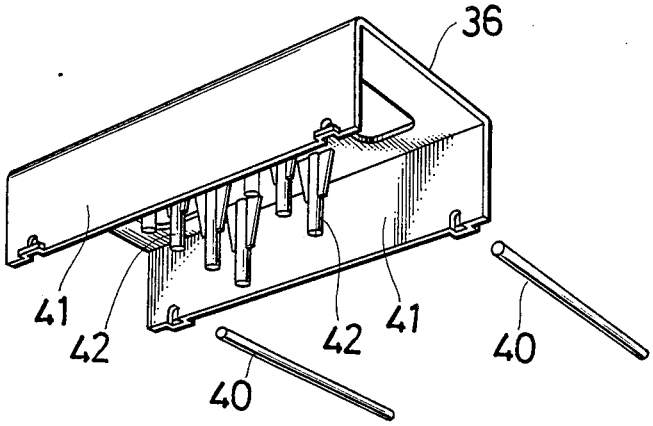
FIG. 5 is a perspective view of a slider of the movable member of FIG. 2.

Referring also to FIG. 5, a pair of rods 40 are secured to and extend between a pair of side walls 41 of the slider 36, and a plurality of, seven in the embodiment, guide pins 42 are formed on and extend downwardly from a lower face of the casing 28. The guide pins 42 are each located between adjacent ones of the movable folding plates 29*a*, 29*b*, 29*c* and 29*d* so that they act as spacers for the movable folding plates 29*a*, 29*b*, 29*c* and 29*d*. The guide pins 42 are formed alternately at forward and rearward locations of the slider 36 as seen from FIGS. 3 and 5.

Referring to FIGS. 3 and 4, the rods 40 of the slider 36 extend perpendicularly through the guideways 35 of the movable folding plates 29*a*, 29*b*, 29*c* and 29*d*. When the slider 36 is positioned at its rearmost position as shown in FIG. 3, the rods 40 of the slider 36 are positioned at the rear ends (left ends in FIG. 3) of the guideways 35 of the movable folding plates 29*a*, 29*b*, 29*c* and 29*d*, but when the slider 36 is positioned at its front most position, the rods 40 are positioned at the front ends of the guideways 35. Thus, when the slider 36 is moved from the rearmost position to the frontmost position or vice versa, the rods 40 move along the guideways 35. During such movement of the rods 40, they do not move the movable folding plates 29*a*, 29*b*, 29*c* or 29*d* when they move along the lower or upper horizontal portions 35*a* or 35*b* of the guideways 35. To the contrary, when the rods 40 move along the inclined portions 35*c* of the guideways 35, they move the movable folding plates 29*a*, 29*b*, 29*c* and 29*d* up or down between an upper position and a lower position. In particular, when the slider 36 is moved from the rearmost position to the frontmost position, the movable folding plates 29*a*, 29*b*, 29*c* and 29*d* are moved down from the upper to the lower positions. In this instance, since the inclined portions 35*c* of the guideways 35 are formed in such an offset relationship in the movable folding plates 29*a*, 29*b*, 29*c* and 29*d* as described hereinabove, the movable folding plates 29*b* are moved down after the movable folding plates 29*a* have been fully moved down to the lower positions, and the movable folding plates 29*c* are moved down after the movable folding plates 29b have been fully moved down. In this manner, the movable folding plates 29a, 29b, 29c and 29d are moved down successively to the individuâl lower positions as shown in FIGS. 7a to 7e. To the contrary, when the slider 36 is moved rearwardly from the frontmost positions to the rearmost position, the movable folding plates 29a, 29b, 29c and 29d are moved up successively in the reverse order.

Figure 7A:
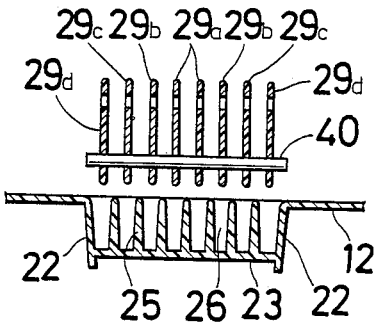
Figure 7B:
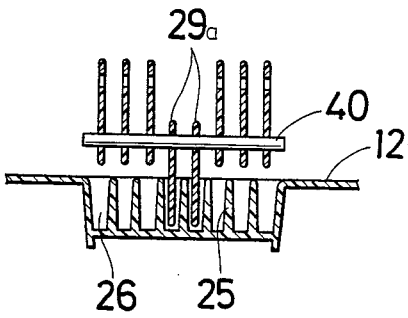
Figure 7C:
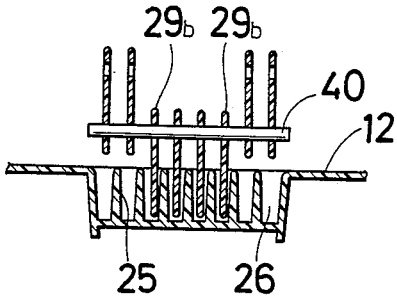
Figure 7D:
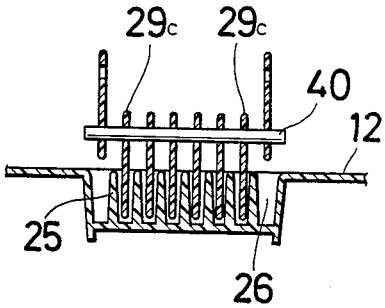
Figure 7E:
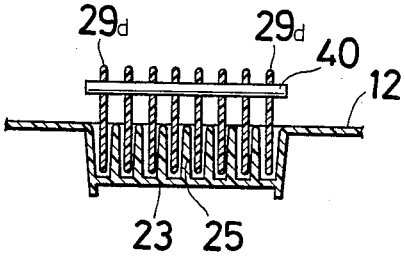

In making an artificial flower using the sheet folding device described above, at first the movable member 13 is pivoted upwardly as seen in FIG. 2, and then a suitable number of sheets of paper 43 are placed in a layered stack on the sheet receiving table 12 such that they extend perpendicularly above the fixed folding plates 25 in the recess 20 of the base 11. Then, the movable member 13 is pivoted down to its lower operative position as shown in FIGS. 1 and 3. After then, the knob 37 is manually moved forwardly (rightwardly in FIG. 3) from the rearmost position to the frontmost position whereupon the slider 36 is moved in an integral relationship with the knob 37. Upon such forward movement of the slider 36, at first the centrally located movable folding plates 29a are moved down from the upper position shown in FIG. 7a in the opposing spacings 26 in the recess 20 of the base 11 as shown in FIG. 7b whereupon the paper stack 43 is partially pushed down into the spacings 26 by the movable folding plate 29a while it is partially held at the top of the centrally located fixed folding plate 25. Then, the movable folding plates 29a on the opposite sides of the movable folding plates 29a are moved down into the opposing spacings 26 as shown in FIG. 7c whereupon portions of the paper stack 43 on the opposite sides of the portions pushed in the spacings 26 by the movable folding plates 29a are pushed down into the opposing spacings 26 while the paper stack 43 is partially held at the top ends of the three centrally located fixed folding plates 25. After then, the outer movable folding plates 29c and 29d are successively moved down into the respective opposing spacings 26 as shown in FIGS. 7d and 7e, respectively, pushing outer portions of the paper stack 43 into the opposing spacings 26. Consequently, when the slider 36 comes to its frontmost position, the paper stack 43 extends in an accordion fashion along a clearance defined by the movable folding plates 29a, 29b, 29c and 29d and the fixed folding plates 25 as well as the side walls 22 of the recess 20 of the base 11. Then, the knob 37 is manually moved back to the rearmost position as shown in FIG. 1 to move the slider 36 back to its initial position. In the initial position of the slider 36, the paper stack 43 folded in an accordion fashion is received in the spacings 26 of the recess 20 and the movable folding plates 29a, 29b, 29c and 29d are positioned above the fixed folding plates 25 with the gap 19 left therebetween as particularly seen in FIG. 8. After then, the movable member 13 is pivoted upwardly as shown in FIG. 2, and then the paper stack 43 folded in an accordion fashion is picked up away from the recess 20 of the base 11. In this instance, the sidewardly expanded portions 24 (refer to FIGS. 2 and 5) of the recess 20 and the cutaway portions 27 of the fixed folding plates 24 facilitate holding at a central portion of the folded paper stack 43 by the thumb and a finger of a hand of an operator.

Figure 12A:
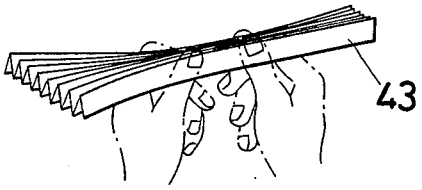
Figure 12B:
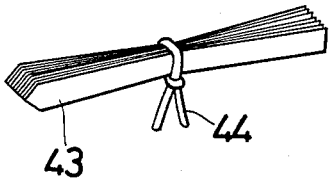

After picked up from the recess 20, the folded paper stack 43 is stroked toward opposite ends thereof by the thumb and a finger of a hand of the operator as illustrated in FIG. 12a. Then, the folded paper stack 43 is tied or bundled by a string 44, a rubber ring or the like as illustrated in FIG. 12b. After then, opposite end portions of the paper sheets of the folded paper stack 43 are drawn up or opened as illustrated in FIG. 12c and are arranged into petal-like configurations. With such steps, an artificial flower is completed.

Figure 12D:
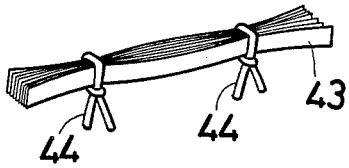
Figure 12C:
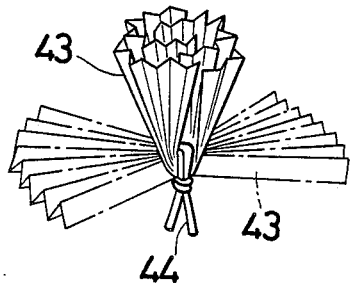

It is to be noted that, when it is intended to make an artificial flower of a smaller size, the folded paper stack 43 may be tied or bundled at two or more locations thereof by strings 44 as shown in FIG. 12d and then cut at an intermediate location or locations into two or more sections which may each be thereafter arranged into an artificial flower.

Further, if opposite ends of the folded paper stack 43 are cut, for example, in such a manner as shown at the left end of the folded paper stack 43 in FIG. 12b, then an artificial flower produced from the folded paper stack 43 may present a different funny appearance.

Referring now to FIGS. 9 to 11, there is shown a sheet folding device according to a second embodiment of the present invention. The sheet folding device includes a fixed base 51, and a movable member 52 mounted at a rear end thereof for pivotal motion at a rear end of the base 51 by means of a pivot shaft 53. The base 51 is molded from a plastic material and has a sheet receiving table 54 at the top thereof. The base 51 further has gap air of front and rear groups of upright plates 55 formed in an integral relationship thereon and in an equidistantly spaced relationship in the widthwise direction thereof. The upright plates 55 of the front group are aligned with the upright plates 55 of the rear group, and another upright plate 56 is interposed in an aligned relationship in a spacing between each of the aligned upright plates 55 of the front and rear groups. Each of the aligned upright plates 55 and 56 constitutes a fixed folding plate 57 having a similar function to each of the fixed folding plates 24 of the first embodiment described above. Thus, as apparently seen from FIG. 10, the sheet folding device includes up to 9 such fixed folding plates 57 with a spacing 58 left between each adjacent ones of the ribs 57.

The upright plates 56 are connected at lower ends thereof in an integral relationship to a frame 59 integrally connected to and supported at an intermediate portion of an operating lever 60 which has a rear end supported for pivotal motion on a right side wall 61 of the base 51 and has a front end portion extending outwardly from a left side wall 62 of the base 51. The frame 59 is normally urged upwardly by means of a pair of tension coil springs 63 extending between the frame 59 and the sheet receiving table 54 of the base 51 to an operative position in which the upright plates 56 thereon are in level with the aligned upright plated 55 of the base 51 to complete the fixed folding plates 57.

Meanwhile, the movable member 52 includes up to 8 movable folding plates 64a, 64b, 64c and 64d of a same configuration fitted for up and down movement in slits not shown formed in lower edges of a pair of depending walls 65 of the movable member 52. The movable folding plates 64a, 64b, 64c and 64d are arranged in the same order as the movable folding plates 28a, 28b, 28c and 28d in the first embodiment described hereinabove. The movable folding plates 64a, 64b, 64c and 64d are each urged upwardly by a pair of tension coil springs 66 extending between each of the movable folding plates 64a, 64b, 64c and 64d and the movable member 52. The movable folding plated 64a, 64b, 64c and 64d are located in an opposing relationship to the spacings 58 between the fixed folding plates 57, that is, in the same planes with the spacings 58 and are positioned, when the movable member 52 is in its lower operative position, above the top ends of the fixed folding plates 57 with a small gap 67 left therebetween.

A mechanism for moving the movable folding plates 64*a*, 64*b*, 64*c* and 64*d* down into the opposing spacings 58 between the fixed folding plates 57 includes a cam member 68 mounted for rotation on the movable member 52 by means of a crankshaft 69 of a crank 70. The cam member 68 has such a specific configuration as seen in FIG. 11 wherein it has a greater diameter circumferential face 71, and a smaller diameter circumferential face 72. The greater and smaller diameter circumferential faces 71 and 72 are delineated on one hand by a first radial step 73*a*, a pair of second radial steps 73*b*, a pair of third radial steps 73*c* and a pair of fourth radial steps 73*d* (only one is shown in FIG. 11) and on the other hand by a single step 74. The cam member 68 is located such that the radial steps 73*a*, 73*b*, 73*c* and 73*d* thereof are positioned in the same planes with the movable folding plates 64*a*, 64*b*, 64*c* and 64*d* and is normally positioned such that the smaller diameter circumferential face 72 thereof contacts with the top ends of the movable folding plates 64*a*, 64*d*, 64*c* and 64*d* as shown in FIG. 9. Thus, if the cam member 68 is rotated in the counterclockwise direction in FIG. 9, the movable folding plates 64*a*, 64*b*, 64*c* and 64*d* are successively contacted and pushed down from individual upper positions to lower positions by the radial steps 73*a*, 73*b*, 73*c* and 73*d* of the cam member 68. Here, the radial steps 73*a*, 73*b*, 73*c* and 73*d* are circumferentially spaced from each other such that, when a movable folding plate 64*a*, 64*b* or 64*c* is fully moved down to its lower position by a corresponding radial step 73*a*, 73*b* or 73*c*, a next movable folding plate 64*b*, 64*c* or 64*d* begins to be pushed down by a corresponding step 73*b*, 73*c* or 73*d* of the cam member 68. The movable folding plates 64*a*, 64*b* or 64*c* which have been moved down to the lower positions by the corresponding step or steps 73*a*, 73*b* or 73*c* of the cam member 68 are thereafter held at their lower positions by the greater diameter circumferential face 71 of the cam member 68.

In making an artificial flower using the sheet folding device having such a construction as described above, a handle 75 mounted at an end portion of the crank 70 is manually operated to rotate the cam member 68 in the counterclockwise in FIG. 9 after a stack of sheets of paper not shown has been placed in position on the sheet receiving table 54 of the base 51. Consequently, the movable folding plates 64*a*, 64*d*, 64*c* and 64*d* are successively moved down into the spacings 58 between the fixed folding plates 57, thereby folding the paper stack in an accordion fashion in such a manner as described hereinabove with reference to the first embodiment. After then, the movable member 52 is manually pivoted upwardly, and then the operating lever 60 is manually pivoted down whereupon the upright plates 56 are moved down away from the folded paper stack. In this condition, the thumb and a finger of a hand of an operator are inserted into a pair of finger windows 76 formed in the base 51 to pick up the folded paper stack from the fixed folding plates 57 of the base 51. The folded paper stack thus picked up will thereafter be treated so as to form an artificial flower by similar steps to those described hereinabove in connection with the first embodiment.

It is to be noted that, while in the embodiments described above the movable folding plates are successively moved down beginning with centrally located ones and ending with outermost ones. However, they may otherwise be successively moved down beginning with one of outermost ones and ending with the other outermost one.

Having now fully described the invention, it will be apparent to one of ordinary skill in the art that many changes and modifications can be made thereto without departing from the spirit and scope of the invention as set forth herein.

What is claimed is:

1. A device for folding a sheet in an accordion fashion, comprising a fixed base having a sheet receiving table at the top thereof, a movable member mounted for movement between an inoperative position in which a sheet can be placed on said sheet receiving table of said base and an operative position in which said movable member is positioned above said fixed base with a predetermined gap left therebetween, a set of fixed folding plates provided on said fixed base and arranged in parallel to each other with predetermined spacings left therebetween, a set of movable folding plates mounted on said movable member for individual parallel movement in the same planes with said spacings between said fixed folding plates, each of said movable folding plates being movable, when said movable member is in the operative position, between an inoperative position in said movable member and an operative position wherein it is fitted in a corresponding one of said spacings between said ribs, and a manually operable actuating means for successively moving, when said movable member is in the operative position, said movable folding plates relative to said movable member from the inoperative positions to the operative positions to fold, cooperating with said fixed folding plates, a sheet received on said sheet receiving table of said base in an accordion fashion.

2. A device as claimed in claim 1, wherein said actuating means moves said movable folding plates successively beginning with a centrally located one or ones and ending with a pair of opposite outwardly located ones.

3. A device as claimed in claim 1, wherein said actuating means moves said movable folding plates successively beginning with one of a pair of opposite outwardly located ones and ending with the other outwardly located one.

4. A device as claimed in claim 1, wherein said fixed folding plates have cutaway portions formed at longitudinal central locations thereof for facilitating holding of a folded sheet by a hand of an operator.

5. A device as claimed in claim 4, wherein said fixed folding plates are formed in an integral relationship with said base from a plastic material.

6. A device as claimed in claim 4, wherein said base has a pair of recessed portions formed therein adjacent said cutaway portions of said fixed folding plates, said recessed portions being of a sufficient size to allow the thumb or a finger of a hand of an operator to be fitted therein.

7. A device as claimed in claim 1, wherein each of said fixed folding plates consists of a pair of fixed portions and a movable portion interposed between said fixed portions, the movable portion of said fixed folding plates being mounted on a manually operable member which moves, when manually operated, said movable portion so said fixed folding plates away from a folded sheet held on the fixed portions of said fixed folding plates to facilitate holding of the folded sheet by a hand of an operator.

8. A device as claimed in claim 1, wherein each of said movable folding plates has a pair of cam slots of a same configuration formed therein, and said actuating means includes a slider mounted for sliding movement on said movable member and cooperating, when slidably moved, with said cam grooves to move said movable folding plates to the operative positions, said movable folding plates being different from each other in configuration of said cam slots so as to be successively actuated by said slider.

9. A device as claimed in claim 1, wherein said movable folding plates have a same configuration, and said actuating means includes a cam member mounted on said movable member and having a plurality of cam sections for successively engaging with and moving said movable folding plates to the operative positions.

* * * * *